US005408232A

United States Patent [19]

Tsai et al.

[11] Patent Number: 5,408,232

[45] Date of Patent: Apr. 18, 1995

[54] TRAFFIC SIGNAL DEVICE WITH INTERCHANGEABLE LAMPS

[75] Inventors: Rung-Ywan Tsai, Kaohsiung; Chaur-Tsang Wei, Taipei; Chii-Hua Lee, Taipei Hsien; Fang-Chuan Ho, Hsinchu, all of Taiwan, Prov. of China

[73] Assignee: Industrial Technology Research Institute,

[21] Appl. No.: 37,245

[22] Filed: Mar. 25, 1993

[51] Int. Cl.[6] ..... G08G 1/00

[52] U.S. Cl. ..... 340/907; 340/916; 340/925; 340/931; 340/480; 340/482; 340/487; 116/63 R

[58] Field of Search ..... 340/907, 916, 925, 931, 340/480, 481, 482, 483, 484, 485, 486, 487, 488, 489, 490; 116/63 R

[56] References Cited

U.S. PATENT DOCUMENTS

| | | | |
|---|---|---|---|
| 2,557,531 | 6/1951 | Blanchet | 340/931 |
| 3,618,005 | 11/1971 | Jensen | 340/930 |
| 3,688,259 | 8/1972 | Robillt | 340/907 |
| 4,851,832 | 7/1989 | Graf | 340/907 |
| 4,857,920 | 8/1989 | Kataoka et al. | 340/907 |
| 4,954,822 | 9/1990 | Borenstein | 340/907 |
| 5,136,287 | 8/1992 | Borenstein | 340/907 |

*Primary Examiner*—John K. Peng
*Assistant Examiner*—Edward Lefkowitz
*Attorney, Agent, or Firm*—Merchant, Gould, Smith, Edell, Welter & Schmidt

[57] ABSTRACT

A traffic signal device having a single, continuously-illuminating lamp and several plain reflectors constructed by optical thin film technique to receive the light beam projected from the lamp and respectively reflecting light components of pre-determined wavelengths to display differently-colored traffic signals. Also, is a lamp detection system which monitors and detects the operation of the lamp and generates a signal to actuate the lamp interchanging mechanism to automatically replace the lamp with a spare lamp once the lamp malfunctions.

26 Claims, 6 Drawing Sheets

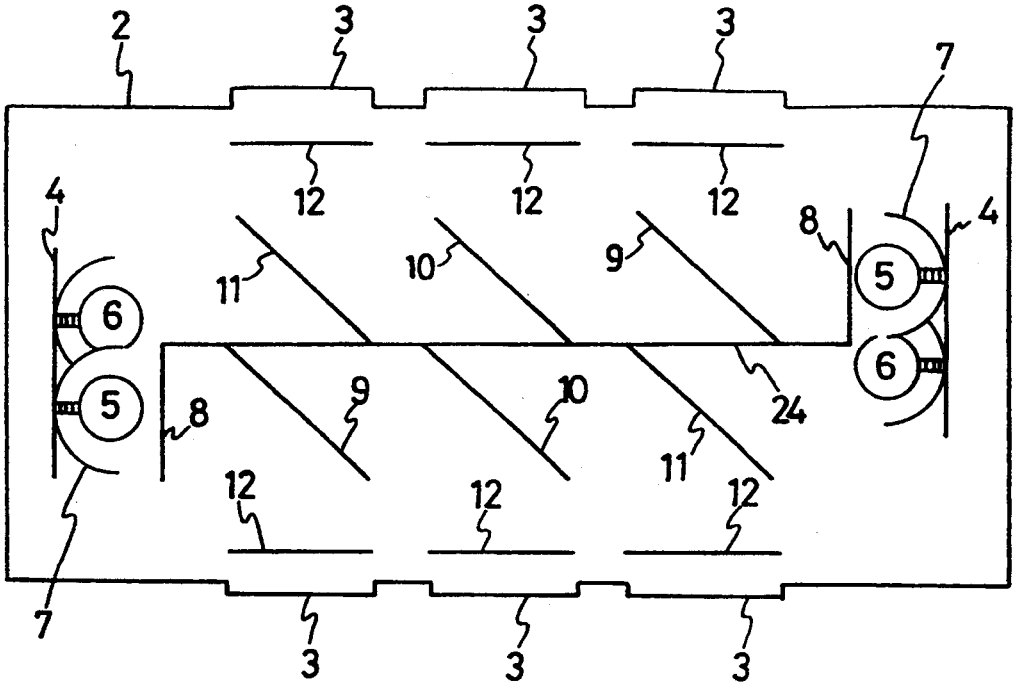
FIG. 2a
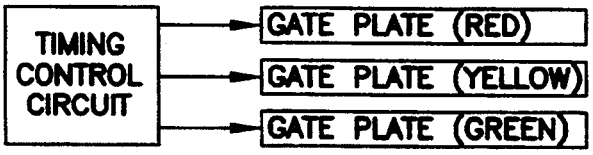
FIG. 2b
FIG. 3
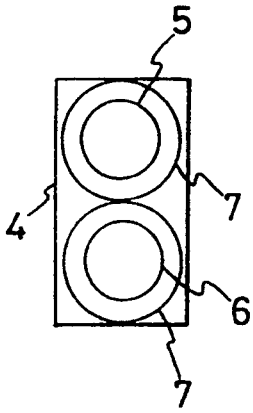

TRAFFIC SIGNAL DEVICE WITH INTERCHANGEABLE LAMPS

BACKGROUND OF THE INVENTION

1. Field of the Invention

The present invention relates generally to a traffic signal device constructed in accordance with the coloring phenomenon of optical thin films. Theoretically, the color performance of optical thin films is based on the phenomenon that waves reflected from interfaces of different depths interfere with each other. The present invention adapts such an optical principle to make use of the wave interference of a multilayer coating to increase the intensity of a specific wave length so as to display a desired color. Further, due to the fact that the spectra of the red light, the yellow light and the green light are substantially not overlapped by each other, a particularly designed thin films configuration may reflect and thus display red signal, yellow signal and green signal from a white light beam to provide the required traffic signals of different colors.

2. Description of the Prior Art

Conventional traffic signal devices comprise a housing inside which at least a red signal unit, a yellow signal unit and a green signal unit are mounted. The housing is supported by a frame which is usually located on the intersection of roads or streets. Each of the signal units comprises an illuminating source or a lamp secured within a parabolic reflector with a hood lens made of colored, light-transmittable plastics or glass disposed in front thereof. Such a prior art arrangement requires at least three lamps for a complete set in a traffic signal device which usually includes at least a red signal, a yellow signal and a green signal. The power consumption of one of such lamps is generally between 69 to 135 watts each lamp, depending upon the required brightness of the signals. The consumption of electrical power is one of the major costs of the traffic signal device.

Further, there are other shortcomings of the conventional traffic signal device. For example: (1) sun light which is incident onto and through the hood lens and reflected by the parabolic reflector will imitate the normal lighting of the traffic signal and creating a phantom image which very probably leads to traffic accidents; this is the well-known sun phantom effect; (2) the switching between different signals requires that the associated lamps be turned off/on frequently which not only consumes more power but also shortens the service life of the lamps and as a consequence, maintenance and replacement cost of the lamps increases and traffic control becomes more difficult due to the temporary shut down of the lamps in maintenance and replacement; and (3) the large amount of heat generated by the lamps and the radiation of sun light deteriorate the colored hood lens and the color thereof fades and as a result, the traffic signals projected therethrough becomes pale and weak.

SUMMARY OF THE INVENTION

A primary object of the present invention is to provide a traffic signal device which comprises a single, continuously-illuminating lamp to function as an illuminating source which provides a light beam to several plain reflectors constructed by optical thin film techniques to project out traffic signals of different colors. The projection of traffic signals is controlled by associated gate plates which are in turn controlled by a timing control circuit so as to allow the traffic signal of a specific color to be projected out each time. Such an arrangement provides not only a saving in power consumption but also an elimination of sun phantom effect and also a cut-down of the malfunction probability and maintenance cost of the lamps.

It is another object of the present invention to provide a traffic signal device which adapts a single, continuously-illuminating lamp to replace the multiple, intermittently-illuminating lamps of the prior art. A spare lamp is also provided on a rotatable disk, together with the working lamp, so that when the working lamp malfunctions, an actuator is signalled to rotate the rotatable disk to place the spare lamp on the working position to replace the malfunctioning lamp.

It is a further object of the present invention to provide a traffic signal device which comprises a hot mirror disposed between the light source and the plain reflectors to reflect the infrared component of the light beam projected from the illuminating source and allowing only the visible component thereof to pass so as to eliminate the thermal effect induced on the hood lenses by the illuminating source and thus protecting the hood lenses from aging induced by the heat generated by the illuminating source. This arrangement also increases the distance between the illuminating source and the hood lenses and this also reduces the thermal radiation incident onto the hood lenses from the illuminating source.

It is still an object of the present invention to provide a traffic signal device in which the hood lenses have an anti-reflection coating formed thereon to increase the transmittance thereof from 92% of the conventional design to 98% so as to brighten the traffic signals projected out therethrough.

Other objects and advantages of the invention will be apparent from the following description of a preferred embodiment taken in connection with the accompanying drawings wherein:

BRIEF DESCRIPTION OF THE DRAWINGS

FIG. 2A is a schematic view showing the arrangement of the optical elements inside a housing of the traffic signal device shown in FIG. 1, viewed from the top side thereof;

FIG. 2B is a block diagram showing the operational relationship of the timing control circuit to the gate plates of the traffic signal device shown in FIG. 2A;

FIG. 3 is a front view showing a light generator of the traffic signal device shown in FIG. 1;

DETAILED DESCRIPTION OF THE PREFERRED EMBODIMENTS

Figure 1A:
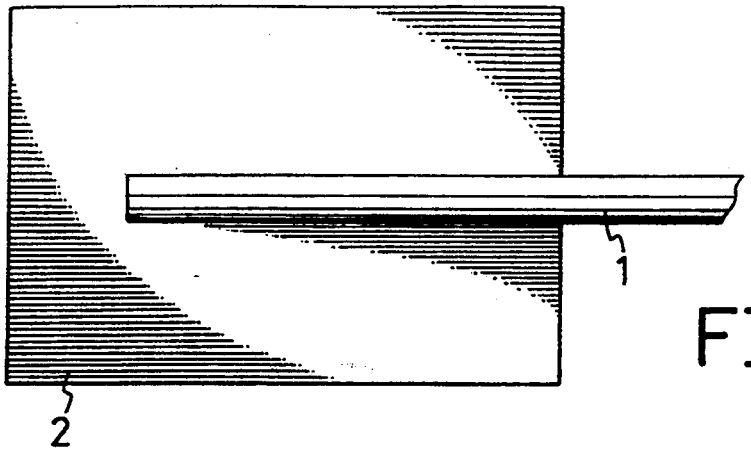
FIGS. 1*a*, 1*b* and 1*c* are respectively a top plan view, a front view and a side elevational view of a traffic signal device constructed in accordance with the present invention.
Figure 1B:
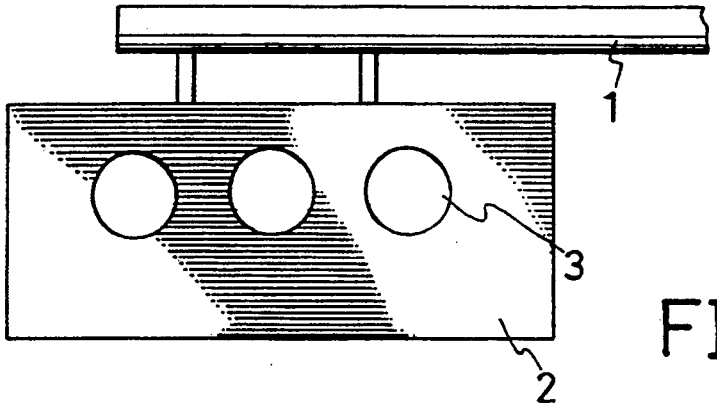
Figure 1C:
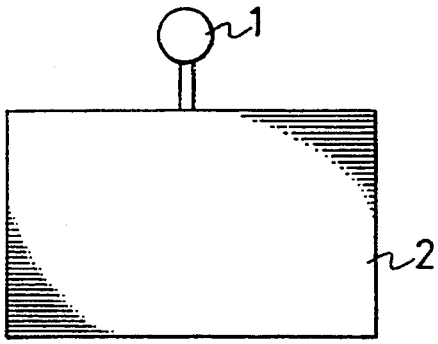

With reference to the drawings and in particular to FIG. 1 wherein a traffic signal device made in accordance with the present invention is shown, the traffic signal device has an appearance similar to a conventional traffic signal device, namely the traffic signal device comprises, in outer configuration, a housing 2 hung or secured on a support 1 and the housing 2 has, on each of two opposite side surfaces thereof, a plurality of signal units, each comprising an anti-reflection hood lens 3 mounted on the opposite side surfaces of the housing 2. Preferably, on each of side surfaces of the housing 2, at least three signal units are mounted as shown in FIG. 1*b*. The three signal units preferably include a red unit, a yellow unit and a green unit as those of the conventional traffic signal device. However, it should be noted that the color or number of the signal units is not limited to what is specified in the above and other colors or numbers may be adapted, if necessary, without departing from the principle of the present invention.

With reference to FIG. 2A, wherein a schematic view of the interior arrangement of the traffic signal device shown in FIG. 1 is shown, there are provided two light generators disposed inside the housing 2 respectively functioning to provide light beams to the signal units of the two side surfaces of the housing 2. Each of the light generators comprises two illuminating sources or lamps, one of which is a working lamp 5 and the other is a spare lamp 6, mounted on a rotatable disk 4 with an included angle of 180 degrees with respect to each other. The light emitted from the working lamp 5 is reflected by a parabolic reflector 7 to give off a light beam in a substantially parallel manner to a hot mirror 8 which allows only the visible component of the light beam from the working lamp 5 to transmit therethrough and reflects the infrared component thereof.

The visible light is then directed toward a first plain reflector 9 having an incident angle of 45 degrees which in the embodiment described is a red reflector, to allow a first component of the incident visible light, which in this embodiment is the red component, to be reflected and redirected to a first one of the anti-reflection hood lenses 3 to display a red signal. The red reflector 9 and the first hood lens 3 constitute the red signal unit of the traffic signal device.

The remaining component of the visible light is allowed to pass through the red reflector 9 to proceed toward a second plain reflector 10, also with an incident angle of 45 degrees. The second reflector 10 in the instant embodiment is a yellow reflector and thus a second component, the yellow component, of the incident visible light is reflected and redirected toward a second one of the anti-reflection hood lenses 3 to display a yellow signal. The yellow reflector 10 and the second hood lens 3 constitute the yellow signal unit of the traffic signal device.

The other components of the visible light are allowed to transmit through the yellow reflector 10 and continue proceeding along the original course toward a third plain reflector 11, which fin the embodiment illustrated is a green reflector, also with an incident angle of 45 degrees to reflect and redirect a third component, the green component in the instant embodiment, of the incident light toward a third one of the anti-reflection hood lenses 3 to display a green signal. The green reflector 11 and the third hood lens 3 constitute the green signal unit of the traffic signal device.

The switching between the red, the yellow and the green signals may be conducted by the closing and opening of the gate plate 12 of each of the signal units. As illustrated in FIG. 2B, control of the gate plates 12 may be achieved by a conventional timing control circuit. Since such a timing control circuit is well known to those skilled in the art of traffic signal device, no further discussion will be given hereinafter.

An opaque partition plate 24 may be disposed between the two sets of plain reflector units to eliminate interference therebetween.

In FIG. 3, a front view of the light generators is shown. The working lamp 5 of each of the light generators is disposed at an upper portion of the rotatable disk 4 while the spare lamp 6 is disposed on a lower portion thereof with an included angle of 180 degrees therebetween.

Figure 4:
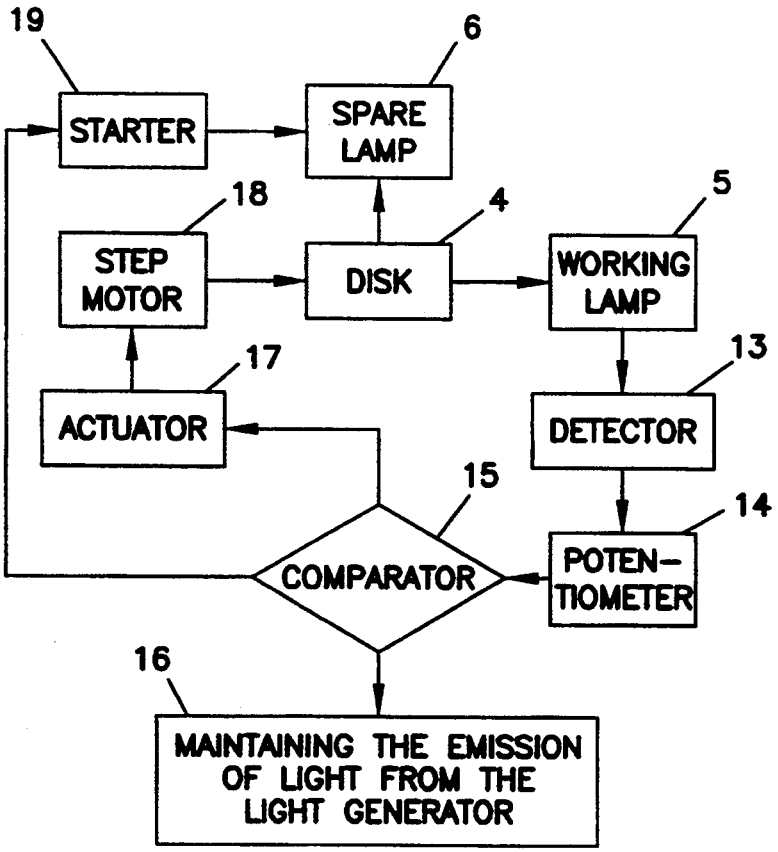
FIG. 4 is a flow chart showing the procedure of changing lamps according to the preferred embodiment of the traffic signal device shown in FIG. 1.

With particular reference to FIG. 4, wherein a flow chart showing the procedure of for interchanging between the working lamp 5 and the spare lamp 6 is illustrated, a detection circuit is provided to detect the malfunction of the working lamp 5 and to initiate the operation of replacing the working lamp 5 which is detected malfunctioning with the spare lamp 6. The detection circuit comprises a detector 13 which continuously detects the light emission of the working lamp 5 and sends out a signal representing the detection to a potentiometer 14. If the working lamp 5 works properly, the potentiometer 14 receives a first voltage signal, such as a 0 volt low voltage, thereby indicating the properly-working condition and when the working lamp 5 malfunctions, the potentiometer 14 receives a second voltage signal, such as a 5 volt high voltage, thereby indicating the malfunction. The potentiometer 14 in turn sends out an output to comparator means 15 which, if the potentiometer 14 receives the low voltage signal, at the step 16, maintains the emission of light from the light generator or, if the potentiometer 14 receives a high voltage signal indicating that the lamp 5 is malfunctioning sends out two outputs, one of which initiates an actuator means 17 to have a step motor 18 drive the rotatable disk 4 to make a half turn so as to change the positions of the working lamp 5 and the spare lamp 6 and the other output energizes a starter 19 to light the spare lamp 6 which is now playing the role of the working lamp.

Figure 5:
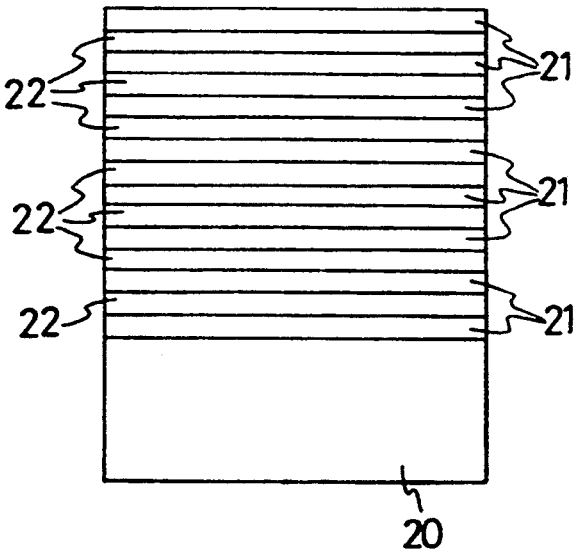
FIG. 5 is a schematic sectional view of the plain reflectors showing the multilayer coating structure deposited on a flat glass or plastic plate used in the traffic signal device of FIG. 1.

Turning now to FIG. 5 which shows a schematic sectional view of the red, the yellow, and the green reflectors 9, 10 and 11, each of the plain reflectors 9, 10 and 11 comprises a substrate 20 made of a transparent plastic material or glass on which a plurality of dioxide material layers are deposited. The dioxide materials deposited on the substrate 20 comprise zirconium dioxide ($ZrO_2$) 21 having a higher refractive index and silicon dioxide ($SiO_2$) 22 having a lower refractive index, which two materials are alternately and repeatedly deposited on the substrate 20 to form a multilayer coating structure. The number of the layers in the multilayer structure is preferably fifteen or more for the plain reflectors 9, 10 and 11.

On each of the anti-reflection hood lenses 3, a similar multilayer structure is formed. Preferably, the multilayer structure on the hood lenses 3 comprises four layers of zirconium dioxide 21 and silicon dioxide 22 alternating with each other.

Figure 6:
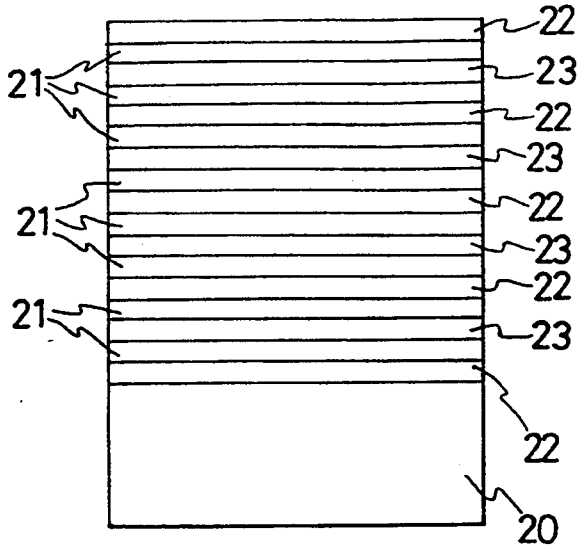
FIG. 6 is a schematic sectional view of the hot mirror showing the mutilayer coating deposited on a flat glass or plastic plate of the traffic signal device of FIG. 1.

With reference to FIG. 6, which shows a schematic sectional view of the hot mirror 8 of the present invention, the hot mirror 8 also comprises a substrate 20 made of a transparent plastic material or glass on which silicon dioxide layers 22, zirconium dioxide layers 21 and titanium dioxide ($TiO_2$) layers 23 are alternately and repeatedly deposited with a total number of seventeen layers to form a multilayer coating structure.

In addition to the high refractive index materials mentioned above, such as zirconium dioxide and titanium dioxide, other materials having a refractive index larger than 1.8, such as nitrides, for example $SiN_x$, and carbides, for example $SiC_x$, can be used as a high refractive index material in the present invention. On the other hand, materials with a refractive index lower than 1.6, such as fluorides, for example $MgF_2$, can be used as a low refractive index material to substitute silicon dioxide.

Figure 7:
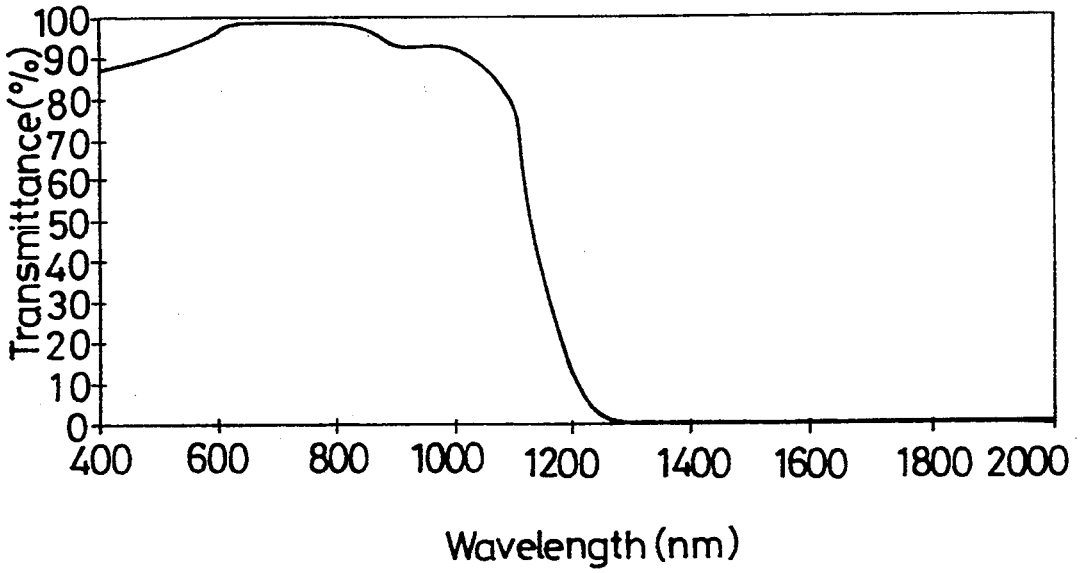
FIG. 7 is a graphic plot showing the spectral transmittance curve of the hot mirror shown in FIG. 6.

With reference to FIG. 7, which shows the spectral transmittance curve of the hot mirror 8 of the present invention, it is observed that lights in the spectral range of near infrared and infrared are all reflected by the hot mirror 8. Namely, only lights with wavelengths shorter than the near infrared are allowed to pass through the hot mirror 8. It should be noted that within the range from red light to green light, almost 100% of the light transmits through the hot mirror 8. In other words, the visible lights between red and green are not affected by the hot mirror 8.

Figure 8:
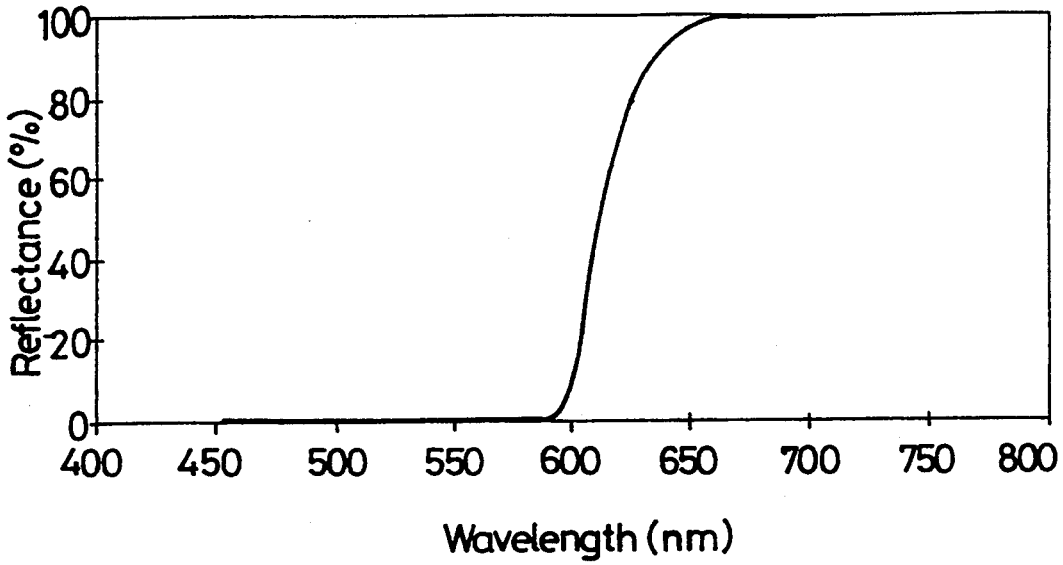
FIG. 8 is a graphic plot showing the spectral reflectance curve of the red reflector shown in FIG. 5, at an angle of incidence of 45°.
Figure 9:
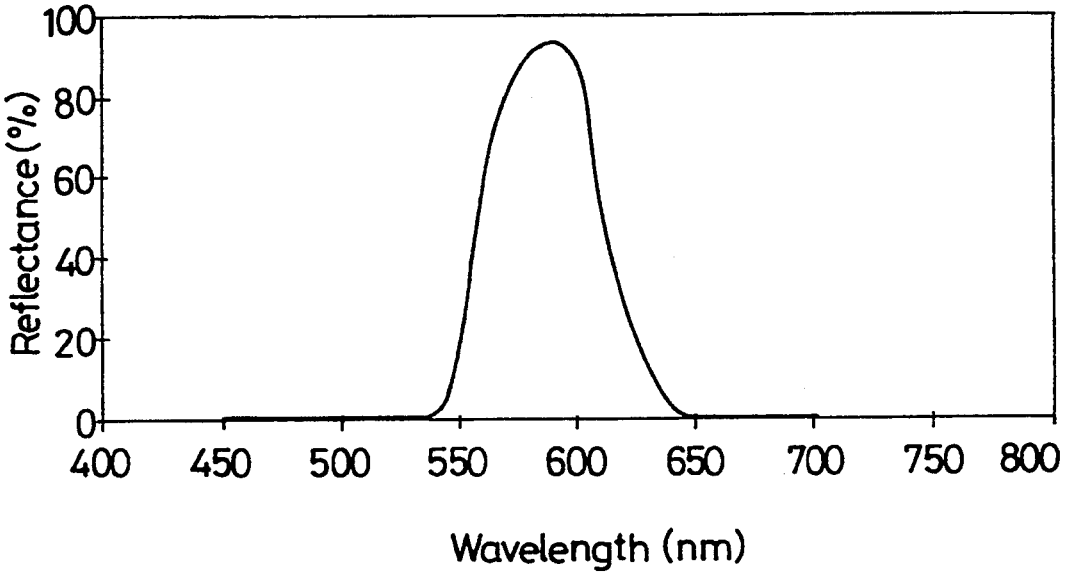
FIG. 9 is a graphic plot showing the spectral reflectance curve of the yellow reflector shown in FIG. 5, at an angle of incidence of 45°.
Figure 10:
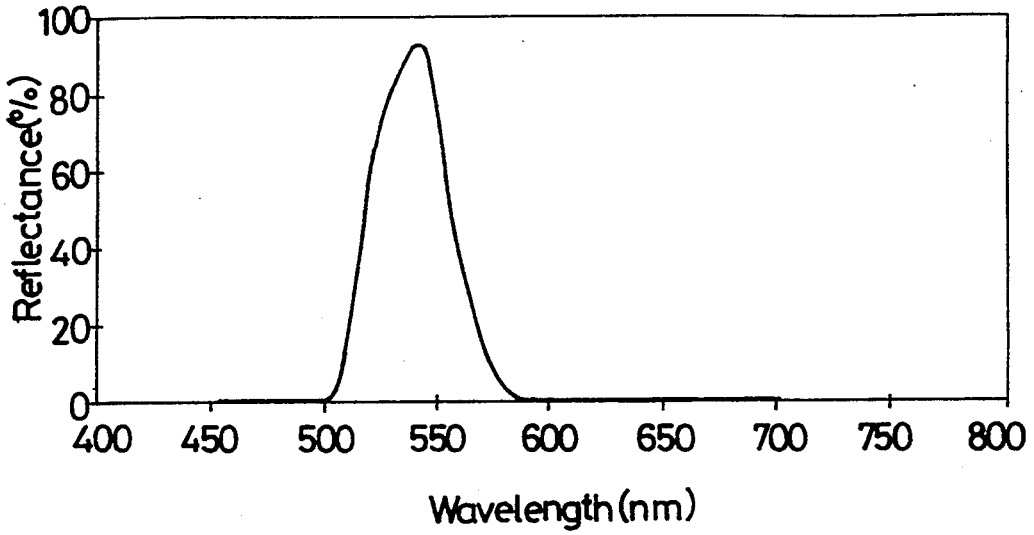
FIG. 10 is a graphic plot showing the spectral reflectance curve of the green reflector shown in FIG. 5, at an angle of incidence of 45°.

With reference to FIGS. 8, 9 and 10, which respectively show the spectral reflectance curve at an incident angle of 45° of the red reflector 9, the yellow reflector 10 and the green reflector 11, it is observed that the spectra of these reflectors are closely next to each other in the visible region so as to fully exploit the applicable spectral range thereof. It is also noted from these plots that in respective spectral range, the plain reflectors reflect and redirect approximately 98% of the respective light while the reflectance drop sharply to zero outside the respective ranges. This means that light which falls within a specific spectral range is almost completely reflected while light of other wavelengths almost completely transmits through the plain reflectors so as to fully exploit the light energy emitted from the light generators.

Figure 11:
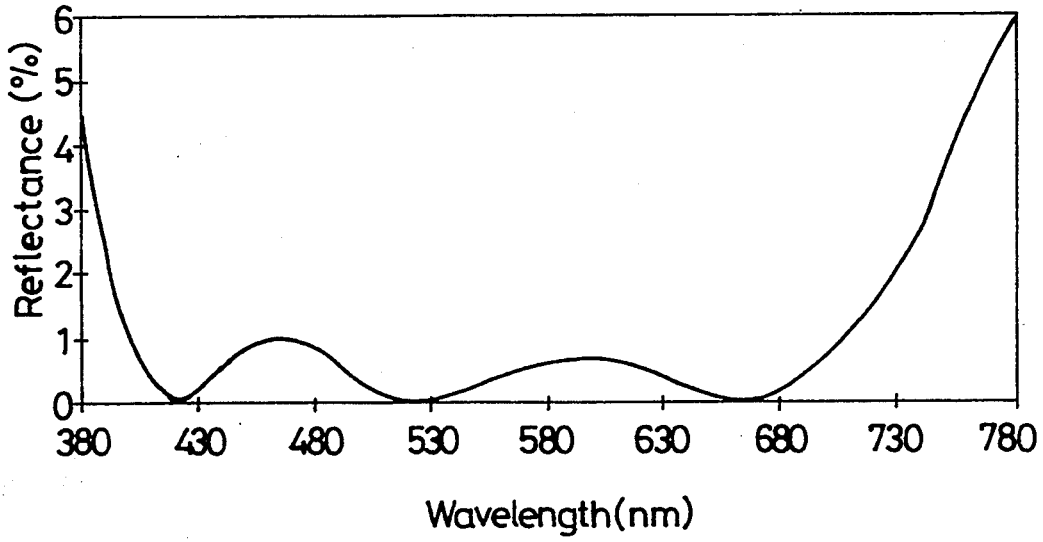
FIG. 11 is a graphic plot showing the spectral near normal reflectance curve of the anti-reflection hood lens used in the traffic signal device shown in FIG. 1.

With reference to FIG. 11, wherein the spectral near normal reflectance curve of the anti-reflection hood lens 3 is shown, it is noted that in the wavelength range from green light to red light, the reflectance is less than 2%, namely 98% of the lights transmitting through the hood lens 3, which, as compared with the 8% reflectance of the prior art non-coated hood lens, is a great improvement in providing a much brighter signal.

To this point, it is understood that the traffic signal device made in accordance with the present invention possesses the following advantages:

(1) A single continuously-illuminating lamp is used to substitute the multiple intermittently-illuminating lamps of the prior art to save the initiating power required to start up lighting and elongate the service life of the lamp.

(2) A spare lamp is provided in the design of the present invention so as to prevent the traffic chaos due to the malfunction of the lamp and also reducing the frequency of changing lamps and thus the labor required to maintain the system.

(3) Plain reflectors are used to replace the conventional colored hood lenses so as to eliminate the sun phantom effect existing in the conventional traffic signal system and due to the fact that the spectra of the reflected lights from each of the plain reflectors are closely next to each other, the optical energy of the light emitted from the light generators is fully exploited.

(4) A hot mirror is provided to eliminate the thermal effect induced by the infrared radiation generated from the light generator and lengthen the distance between the lamp and the hood lenses to reduce the fading and deterioration problems occurring on the conventional hood lenses and thus to elongate the service life of the hood lenses.

(5) A hood lens with a multilayer coating thereon is provided to increase the transmittance of the red, yellow and green lights therethrough to 98% so as to provide a much brighter traffic signal.

(6) A housing which comprises signal units on two opposite side surfaces is provided so as to replace the conventional traffic signal device which has signal units mounted on a single side surface only.

To more clearly illustrate the improvements of the present invention over the prior art, a comparison of the present traffic signal device with the prior art devices is listed in the following table:

| | PRESENT INVENTION | PRIOR ART |
|---|---|---|
| 1. performance: | | |
| a. phantom effect: | no | yes |
| b. fading: | no | yes |
| c. brightness: | high | low |
| 2. service life: | | |
| a. hood: | long | short |
| b. lamp: | long | short |
| 3. quantity of lamps in use: | 1 | at least 3 |
| 4. operation on both sides: | yes | no |
| 5. reliability: | good | bad |
| 6. maintenance of lamps: | less | often |

It is apparent that although the invention has been described in connection with a preferred embodiment, those skilled in the art may make changes to certain features of the preferred embodiment without departing from the spirit and scope of the invention as defined in the appended claims.

What is claimed is:

1. A traffic signal device comprising:

light generator means comprising a continuously-illuminating lamp to emit a light beam along a path;

a number of plain reflectors spacedly lined up in series along the path of said light beam, each of said plain reflectors being disposed in an inclined manner with respect to the path of said light beam to receive said light beam incident thereon with an incident angle and reflecting a light component thereof falling within a specific wavelength range and allowing the remaining components of said light beam to pass therethrough so as to project out a number of differently-colored traffic signals in correspondence to said number of plain reflectors respectively through a corresponding number of transparent hood lenses; and a corresponding number of openable gate plates which respectively block said hood lenses and thus controlling the projections of the differently-colored traffic signals.

2. A device as claimed in claim 1 further comprising a hot mirror disposed on the path of said light beam to prevent an infrared component of said light beam from being incident onto said plain reflectors and said hood lenses.

3. A device as claimed in claim 1 wherein each of said hood lenses comprises an anti-reflection coating formed thereon to increase the transmittance of said differently-colored traffic signals therethrough.

4. A device as claimed in claim 1 wherein said light generator means further comprises a second lamp which is a spare and wherein said first, continuously-illuminating lamp and said second lamp are both disposed on a rotatable disk which is rotatable through a given angular displacement to interchange said first lamp and said second lamp.

5. A device as claimed in claim 1 wherein each of said plain reflectors comprises a substrate with a coating formed thereon and said coating comprises a multilayer structure formed by alternately and repeatedly depositing layers of a first material having a high refractive index and layers of a second material having a low refractive index.

6. A device as claimed in claim 2 wherein said hot mirror comprises a substrate with a coating formed thereon and said coating comprises a multilayer structure formed by alternately and repeatedly depositing layers of a first material having a low refractive index, layers of a second material having a medium refractive index, and layers of a third material having a high refractive index.

7. A device as claimed in claim 6 wherein said substrate is made of a transparent plastic material or a glass.

8. A device as claimed in claim 6 wherein said material having a high refractive index comprises oxides, nitrides and carbides with a refractive index larger than 1.8.

9. A device as claimed in claim 6 wherein said material having a low refractive index comprises oxides and fluorides with a refractive index smaller than 1.6.

10. A device as claimed in claim 3 wherein the anti-reflection coating of said hood lens comprises a multilayer structure formed by alternately and repeatedly depositing layers of a first material having a high refractive index and layers of a second material having a low refractive index.

11. A device as claimed in claim 10 wherein said material having a high refractive index comprises oxides, nitrides and carbides with a refractive index larger than 1.8.

12. A device as claimed in claim 10 wherein said material having a low refractive index comprises oxides and fluorides with a refractive index smaller than 1.6.

13. A device as claimed in claim 5 wherein said substrate is made of a transparent plastic material or a glass.

14. A device as claimed in claim 5 wherein said material having a high refractive index comprises oxides, nitrides and carbides with a refractive index larger than 1.8.

15. A device as claimed in claim 5 wherein said material having a low refractive index comprises oxides and fluorides with a refractive index smaller than 1.6.

16. A device as claimed in claim 1 wherein said openable gate plates are controlled by a timing control circuit to conduct the switching between the differently-colored traffic signals.

17. A dual-way traffic signal apparatus comprising two sets of symmetrically-arranged optical configurations, each of said optical configurations comprising:

light generator means comprising a first, continuously-illuminating lamp to emit a light beam along a path;

a number of plain reflectors spacedly lined up in series along the path of said light beam, each of said plain reflectors being disposed in an inclined manner with respect to the path of said light beam to receive said light beam incident thereon with an incident angle and reflecting a light component thereof falling within a specific wavelength range and allowing the remaining components of said light beam to pass therethrough so as to project out a number of differently-colored traffic signals in correspondence to said number of plain reflectors respectively through a corresponding number of transparent hood lenses;

a corresponding number of openable gate plates which respectively block said hood lenses and thus controlling the projections of the differently-colored traffic signals; and an opaque partition disposed along a direction parallel to the path of said light beam in such a manner to separate said two sets of optical configurations to avoid interference therebetween.

18. An apparatus as claimed in claim 17 further comprising a hot mirror disposed on the path of said light beam to prevent an infrared component of said light beam from being incident onto said plain reflectors and said hood lenses.

19. An apparatus as claimed in claim 17 wherein each of said hood lenses comprises an anti-reflection coating formed thereon to increase the transmittance of said differently-colored traffic signals therethrough.

20. An apparatus as claimed in claim 17 wherein each of said plain reflectors comprises a substrate with a coating formed thereon and said coating comprises a multilayer structure formed by alternately and repeatedly depositing layers of a first material having a high refractive index and layers of a second material having a low refractive index.

21. An apparatus as claimed in claim 18 wherein said hot mirror comprises a substrate with a coating formed thereon and said coating comprises a multilayer structure formed by alternately and repeatedly depositing layers of a first material having a low refractive index, layers of a second material having a medium refractive index, and layers of a third material having a high refractive index.

22. An apparatus as claimed in claim 21 wherein said substrate is made of a transparent plastic material or a glass.

23. An apparatus as claimed in claim 19 wherein the anti-reflection coating of said hood lens comprises a multilayer structure formed by alternately and repeatedly depositing layers of a first material having a high refractive index and layers of a second material having a low refractive index.

24. An apparatus as claimed in claim 20 wherein said substrate is made of a transparent plastic material or a glass.

25. An apparatus as claimed in claim 17 wherein said light generator means further comprises a second lamp which is a spare and wherein said first, continuously-illuminating lamp and said second lamp are both disposed on a rotatable disk which is rotatable through a given angular displacement to interchange said first lamp and said second lamp.

26. A system for interchanging the first, continuously-illuminating lamp and the second, spare lamp of said light generator means as claimed in claim 4 or 19 wherein both of said first lamp and said second lamp are disposed on said rotatable disk with a given included angle with respect to each other, said system comprising:

detection circuit means to detect said first lamp and generate a signal representing the detection, said detection signal having a first state indicating a proper operation of said first lamp and a second state indicating a malfunction of said first lamp;

comparator means to generate a first output and a second output in response to the second state of said detection signal and to maintain the operation of said first lamp in response to the first state of said detection signal;

actuation means to actuate, in response to the first output of said comparator means, a step motor to provide the given angular displacement to said rotatable disk to move said second lamp to replace said first lamp; and starter means to light said second lamp in response to the second output of said comparator means.

* * * * *